US009334034B1

(12) United States Patent
Waldvogel et al.

(10) Patent No.: US 9,334,034 B1
(45) Date of Patent: May 10, 2016

(54) ENGINE UNIT WITH COMBINED TRIM AND STEERING

(71) Applicant: Brunswick Corporation, Lake Forest, IL (US)

(72) Inventors: David J. Waldvogel, Fond du Lac, WI (US); Niel M. Schueller, Fond du Lac, WI (US); John A. Groeschel, Theresa, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 14/614,773

(22) Filed: Feb. 5, 2015

(51) Int. Cl.
*B63H 20/12* (2006.01)
*B63H 20/32* (2006.01)
*B63H 20/10* (2006.01)

(52) U.S. Cl.
CPC ..... *B63H 20/12* (2013.01); *B63H 20/10* (2013.01); *B63H 20/32* (2013.01)

(58) Field of Classification Search
CPC ..... B63H 20/12; B63H 20/106
USPC ..... 440/57
See application file for complete search history.

(56) References Cited

U.S. PATENT DOCUMENTS 3,847,107 A * 11/1974 Buddrus ..... B63H 25/42 114/144 R
4,318,699 A * 3/1982 Wenstadt ..... B63H 20/10 114/277
4,645,463 A * 2/1987 Arneson ..... B63H 5/125 440/57
4,645,464 A * 2/1987 Rawlings ..... B63H 20/10 440/57
4,836,810 A * 6/1989 Entringer ..... B63H 20/12 440/53
4,960,398 A * 10/1990 Potratz ..... B63H 20/20 440/53
5,002,510 A * 3/1991 Rump ..... B63H 20/12 440/53
5,358,435 A * 10/1994 Rodskier ..... B63H 20/10 440/61 F
5,466,178 A * 11/1995 Inman, Sr. ..... B63H 20/06 114/150
5,562,508 A * 10/1996 Rodskier ..... B63H 20/12 440/61 F
5,707,263 A * 1/1998 Eick ..... B63H 20/10 440/61 F
5,755,604 A * 5/1998 Borgersen ..... B63H 20/10 440/53
6,287,160 B1 * 9/2001 Onoue ..... B63H 20/10 440/61 D (Continued)

OTHER PUBLICATIONS

Unpublished U.S. Appl. No. 14/287,888, filed May 27, 2014.

(Continued)

*Primary Examiner* — Lars A Olson
*Assistant Examiner* — Jovon Hayes
(74) *Attorney, Agent, or Firm* — Andrus Intellectual Property Law, LLP

(57) ABSTRACT

A system and method for combined control of steering and trim of a marine engine unit. The system and method includes a steering apparatus generating steering signals, a trim control generating trim signals, an electronic unit receiving steering trim and cylinder position signals and sending output signals. A port hydraulic cylinder and a starboard hydraulic cylinder that extend and retract are included. The cylinders connected to first and second port and starboard joints to provide movement of the engine unit. The first and second port and starboard joints enable movement of the engine unit vertically and horizontally when the port and starboard hydraulic cylinders are extended and retracted to provide a full range of steering and trim movement of an engine unit using only two hydraulic cylinders.

23 Claims, 9 Drawing Sheets

(56) References Cited

U.S. PATENT DOCUMENTS 6,296,535 B1 * 10/2001 Bland ..... B63H 20/10 440/61 D
6,322,404 B1 * 11/2001 Magee ..... G01B 7/30 440/2
6,454,620 B1 * 9/2002 Theisen ..... B63H 20/10 114/150
6,585,545 B1 * 7/2003 Neisen ..... B63H 20/10 440/57
7,104,853 B1 * 9/2006 Kepka ..... B63H 20/06 440/57
7,347,753 B1 * 3/2008 Caldwell ..... B63H 5/125 114/150
8,070,540 B2 * 12/2011 West ..... B63H 20/10 440/57
2009/0264030 A1 * 10/2009 West ..... B63H 20/10 440/57

OTHER PUBLICATIONS

Unpublished U.S. Appl. No. 14/560,550, filed Dec. 4, 2014.

* cited by examiner

ENGINE UNIT WITH COMBINED TRIM AND STEERING

FIELD

The present invention is generally related to marine engines, and more particularly to a system and method for the combined trim and steering of a marine engine.

BACKGROUND AND SUMMARY

Those skilled in the art of marine engines are familiar with many different types of steering and trim controls. Those familiar with outboard and stern drive engines typically understand that such engines have trim capabilities associated with the lower unit of the engine. The trim adjusts the pitch attitude of the boat or watercraft while it is moving. Changes in watercraft speed or weight placement usually require trim to be adjusted to keep the boat at a comfortable and efficient pitch attitude. This reduces the work of the engine by reducing the amount of manual control necessary, as well as providing for greater efficiency by keeping the watercraft in the ideal orientation for the water conditions.

Steering and trim execution on outboard and stern drive engines is typically accomplished by two sets of hydraulic cylinders—one or more pairs of hydraulic cylinders for steering, and one or more pairs of hydraulic cylinders for controlling trim. External trim cylinders separate from the steering cylinders is common on Mercury® high performance drives, Volvo® stern drives, and other drives known in the art. Other means of steering contemplate utilizing a lever and an internal steering cylinder, particularly on stern drive engines.

Nowhere in the art, however, is there a combination of external steering and trim execution incorporated into one pair of external hydraulic cylinders. The present application utilizes only two external cylinders, controlled via position sensing and hydraulic valves through a software control strategy. The present invention reduces the trim and stern drive function to two cylinders.

Accordingly, the present invention contemplates a system for combined control of steering and trim of an engine unit generating a propelling force. In one embodiment, the engine unit may be a stern drive unit that includes a gimbal housing and bell housing permitting steering and trim movement. A drive is operatively connected to the bell housing. A drive shaft housing is connected to the drive and encloses a drive shaft. A gear case is connected to the drive shaft housing and encloses gears operatively connected to the drive shaft to rotate a propeller. The system includes a port hydraulic cylinder that extends and retracts, the port cylinder having a first end and a second end, the first end connected to the engine unit at a first port joint, the second end connected to the engine unit at a second port joint. Also included is a starboard hydraulic cylinder that extends and retracts, the starboard cylinder having a first end and a second end, the first end connected to the engine unit at a first starboard joint, the second end connected to the engine unit at a second starboard joint. The first and second starboard joints enable movement of the engine unit vertically and horizontally when the port and starboard cylinders are extended and retracted in order to provide the combined control of steering and trim of the engine unit.

The first port joint and the first starboard joint may be connected to the gimbal housing, while the second port joint and the second starboard joint may be connected to the drive shaft housing. However, points of connection to the engine unit may vary insofar as the use of the two hydraulic cylinders to permit both vertical and horizontal movement of the engine unit to provide control of both steering and trim using two hydraulic cylinders. In this system, when both the port hydraulic cylinder and the starboard hydraulic cylinder are fully extended, the stern drive is lifted into a trailering position, and the steering of the stern drive unit is locked.

The present application further contemplates position sensors connected to each of the port hydraulic cylinder and the starboard hydraulic cylinder that generate position signals. The position sensors may include a steering position sensor and a trim position sensor. They may be located on each hydraulic cylinder. Alternatively, the steering position sensor may be located on a gimbal access of the gimbal ring and a trim position sensor may be located on a trim pivot of the gimbal housing. A steering apparatus generating steering signals and a trim control generating trim signals are also present in the system. The system contemplates an electronic control unit that receives the steering trim and cylinder position signals and sends output signals. The hydraulic manifold has solenoid controlled valves connected to the port hydraulic cylinder and the starboard hydraulic cylinder that receive signals from the electronic control unit to extend and retract the cylinders. More particularly, the solenoid controlled valves receive output signals from the electronic control unit to extend or retract the port hydraulic cylinder and the starboard hydraulic cylinder.

The present application further contemplates a method of controlling steering and trim of an engine unit of a watercraft using two hydraulic cylinders. The method includes the steps of providing a port hydraulic cylinder and a starboard hydraulic cylinder connected to the engine unit, the port and starboard hydraulic cylinders extending and retracting. The method further contemplates maintaining hydraulic cylinder in the starboard hydraulic cylinder at neutral positions for driving the watercraft straight without trim. The method contemplates extending the port hydraulic cylinder and the starboard hydraulic cylinder to raise the engine unit upwardly and trim the watercraft. The method also contemplates the step of extending the port hydraulic cylinder and retracting the starboard hydraulic cylinder to steer the watercraft to starboard. The method further contemplates extending the starboard hydraulic cylinder and retracting the port hydraulic cylinder to steer the watercraft to port. Additionally, the method includes the step of partially extending the port hydraulic cylinder and partially extending the starboard hydraulic cylinder to steer the watercraft to starboard with trim, and also the step of partially extending the starboard cylinder and partially retracting the port hydraulic cylinder to steer the watercraft to port with trim.

The method further contemplates a hydraulic manifold with solenoid valves controlled by electronic signals from an electronic control unit that controls the extension and retraction of the port and starboard hydraulic cylinders. Therein, the method further contemplates the steps of receiving in the electronic control unit a steering input signal from a steering apparatus and sending a steering control signal from the electronic control unit to at least one solenoid valve of the hydraulic manifold to extend or retract a hydraulic cylinder. The method also contemplates receiving in the electronic control unit a trim input signal from a trim control and sending a trim control signal from the electronic control unit to at least one solenoid valve of the hydraulic manifold to extend and retract a hydraulic cylinder. In this embodiment of the present invention, at least one steering control sensor provides a steering position signal to the electronic control unit and at least one trim position sensor provides a trim position signal to the electronic control unit. Thus, an embodiment of the present invention includes a method with the additional steps of receiving in the electronic control unit the steering position signal and the trim position signal, adjusting the steering control signal based on the steering position signal, and adjusting the trim control signal based on the trim position signal.

The method of the present application contemplates that the step of extending the port hydraulic cylinder and the starboard hydraulic cylinder to raise the stern drive unit upwardly and trim the watercraft may further comprise fully extending the port hydraulic cylinder and the starboard hydraulic cylinder to raise the stern drive unit to a trailering position. In that embodiment, full extension of the port hydraulic cylinder and the starboard hydraulic cylinder may lock any steering capability. In the above noted method, the engine unit under control might be an outboard engine unit or a stern drive engine unit.

The present application further contemplates a system for combined control of steering and trim of a marine engine unit, the system including a steering apparatus generating steering signals, a trim control generating trim signals, and an electronic control unit, the electronic control unit receiving trim steering and cylinder position signals and sending output signals. A port hydraulic cylinder that extends and retracts is included in the system, the port cylinder having a first end and a second end, the first end connected to an engine unit at a first port joint, the second end connected to the engine unit at a second port joint. The system also includes a starboard hydraulic cylinder that extends and retracts, the starboard cylinder having a first end and a second end, the first end connected to the engine unit at a first starboard joint, the second end connected to the engine unit at a second starboard joint. Position sensors connected to each of the port hydraulic cylinder and the starboard hydraulic cylinder generate the position signals. A hydraulic manifold having solenoid controlled valves connected to the port hydraulic cylinder and the starboard hydraulic cylinder and operating to extend and retract the cylinders is included within the system. The solenoid valves receive output signals from the electronic control unit to extend or contract the port hydraulic cylinder and the starboard hydraulic cylinder and the first and second port and starboard joints enable movement of the engine unit vertically and horizontally when the port and starboard hydraulic cylinders are extended and retracted. Again, in this embodiment of the invention, the engine unit may be either a stern drive unit or an outboard unit.

BRIEF DESCRIPTION OF THE DRAWINGS

The present disclosure is described with reference to the following Figures. The same numbers are used throughout the Figures to reference like features and like components.

DETAILED DESCRIPTION OF THE DRAWINGS

Figure 1:
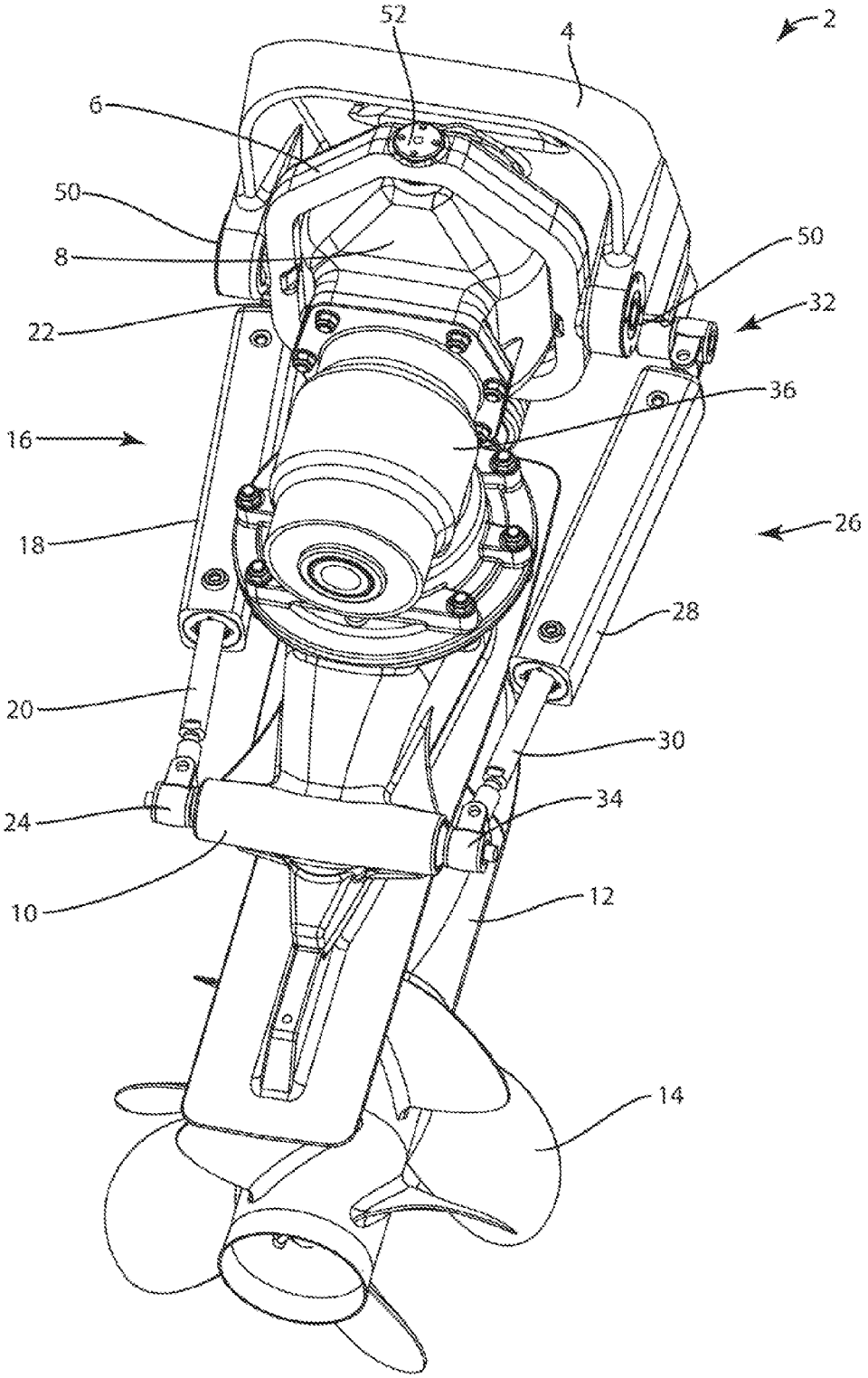
FIG. 1 is a perspective view of an engine unit incorporating the present invention demonstrating the port and starboard hydraulic cylinders in a neutral or straight steering position.

FIG. 1 demonstrates an engine unit 2 incorporating the combined trim and steering capabilities of the present application. In the embodiment shown in the figures, the engine unit 2 is a stern drive engine unit. However, as contemplated in the system and method of the present application may also be applied to a outboard engine unit. The system and method of the present application provide a full range of steering and trim, utilizing only two hydraulic cylinders.

In the embodiment shown in the drawings, the engine unit 2 includes a gimbal housing for attaching the engine unit 2 to a watercraft (not shown). The gimbal housing 4 is connected to a gimbal ring 6 and is also connected to a bell housing 8. The gimbal housing 4 includes a trim pivot 50 while the gimbal ring 6 includes a gimbal axis 52. Movement of the bell housing about the trim pivot 50 and the gimbal axis 52 provides vertical and horizontal movement of the engine unit 2. More particularly, movement about the trim pivot 50 provides vertical movement to trim the engine upwardly and downwardly, while movement about the gimbal axis 52 provides directional steering to the port and starboard. The engine unit 2 further includes a drive shaft housing 10, a gear case 12, and a propeller 14 for propelling a watercraft through a body of water.

As is well known in the art, the engine unit 2 includes a drive 36 that is connected to a drive shaft (not shown) enclosed within the drive shaft housing 10. The drive shaft is connected to gears (also not shown) in the gear case 12, that cause a propeller 14 to rotate when provided with a motive force from the engine.

The present application achieves both steering and trim movement using only two external hydraulic cylinders, namely the port hydraulic cylinder 16 and a starboard hydraulic cylinder 26. The port hydraulic cylinder 16 includes a port cylinder housing 18, a port cylinder rod 20, and is connected to the engine unit 2 at a first port joint 22 at a terminal end of the housing 18. The port hydraulic cylinder 16 is connected at a second point to the engine unit 2 through a second port joint 24 located at the terminal end of the port cylinder rod 20. Likewise, the starboard hydraulic cylinder 26 includes a starboard hydraulic cylinder housing 28 and a starboard cylinder rod 30. The starboard cylinder housing 28 is connected to the engine unit 2 at a first starboard joint 32. The starboard cylinder rod 30 is connected to a second starboard joint 34 to provide a second point of connection of the starboard hydraulic cylinder 26 to the engine unit 2.

In the embodiment shown, the first starboard joint 32 and the first port joint 22 connect the housings 18, 28 to the portion of the gimbal housing 4. However, those with skill in the art will understand that the first port joint 22 and the first starboard joint 32 may be connected at different areas to provide the movement that will be described herein. Likewise, the second port joint 24 and the second starboard joint 34 are connected to the engine unit 2 at the drive shaft housing 10. Again, however, one of ordinary skill in the art will understand that the connection points may vary, so long as the movement described herein is accomplished.

Figure 2:
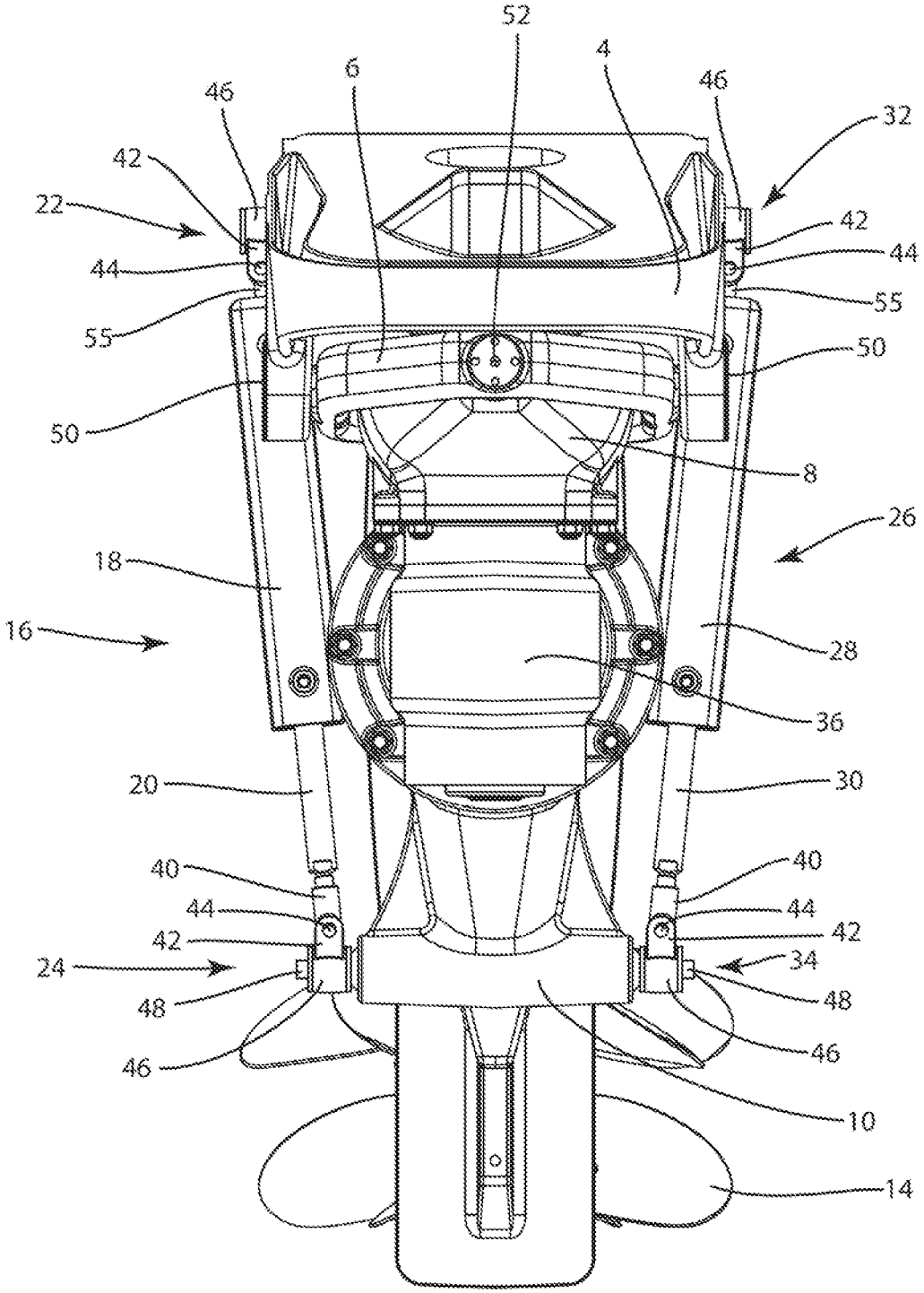
FIG. 2 is a top view of FIG. 1.

In one embodiment and as shown in the top view of FIG. 2, the port hydraulic cylinder 16 and the starboard hydraulic cylinder 26 are connected to the first port joint 22 and the first starboard joint 32, respectively, through an arrangement that includes a rotary bearing 46 rotatable about a rod 48. The rotary bearing 46 includes a clevis 42 extending therefrom. The clevis 42 engages a housing end connection 55 at the terminal end of either the port hydraulic cylinder housing 18 or the starboard hydraulic cylinder housing 28. The housing end 55 is secured to the clevis 42 through a pin 44. In a similar manner, the second ends of the port hydraulic cylinder 16 and the starboard hydraulic cylinder 26 are connected to the second port joint 24 and the second starboard joint 34. The port cylinder rod 20 and the starboard cylinder rod 30 both receive a rod end bearing 40 that attaches to the terminal end of the cylinder rods. The rod end bearings 40 engage the joints 24, 34 through a clevis 42 attached to a rotary bearing 46 that rotates about a rod 48. The rod end bearing 40 is connected to the clevis 42 through pins 44.

The present application contemplates that the joints 22, 24, 32, 34 may be double articulating joints or spherical joints. The joints in conjunction with the extension and retraction of the cylinders 16, 26 permit the engine unit 2 to obtain the fully desired steering angle of plus or minus 28 degrees throughout the useful trim range. The available range of steering decreases as the trim increases up to the trailering position, and at the trailering position the drive is not steerable, but is forced to a locked, straight position.

Figure 3:
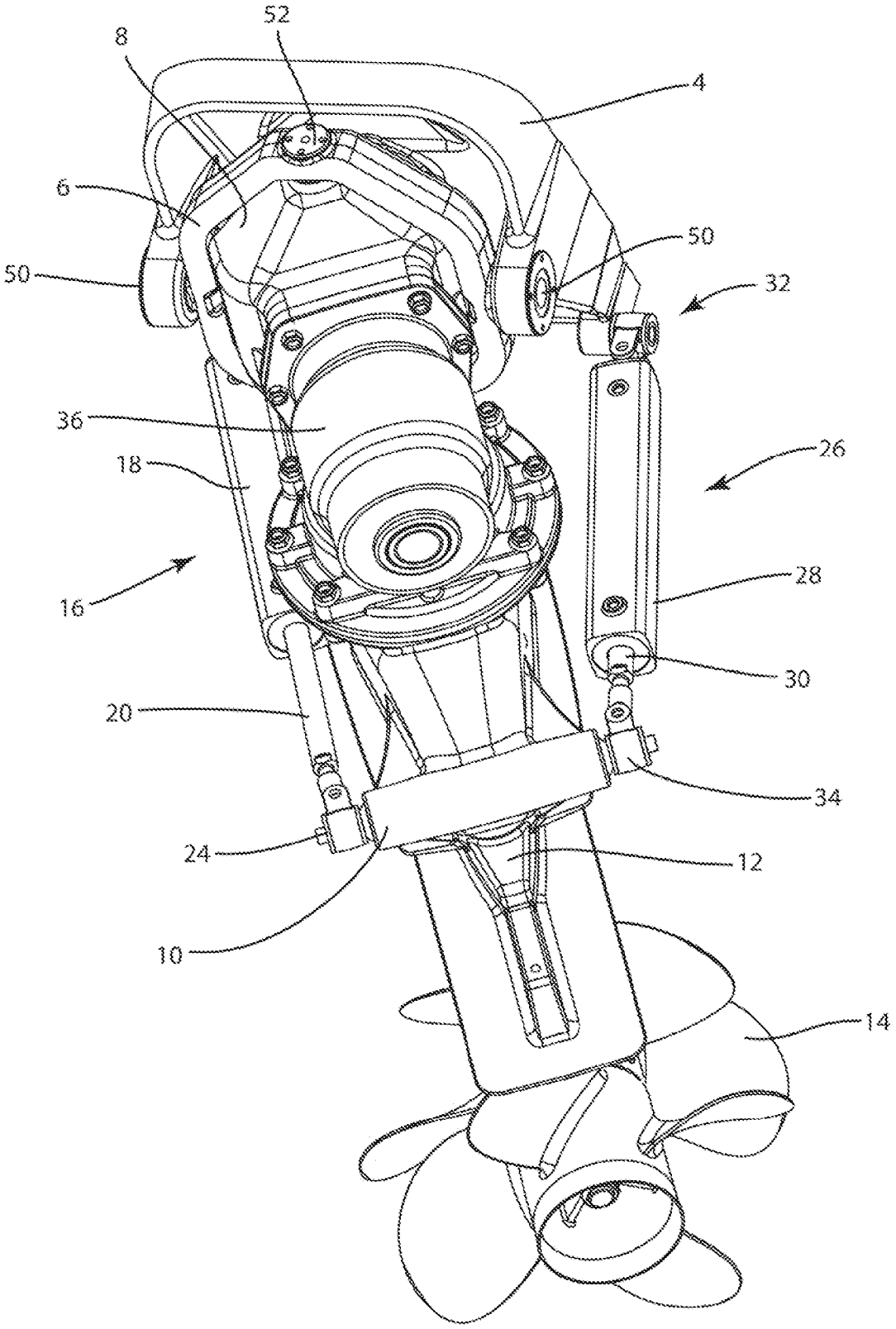
FIG. 3 is a perspective view of an engine unit incorporating the present invention demonstrating extension of the port hydraulic cylinder and retraction of the starboard hydraulic cylinder to provide a starboard turn with no trim.
Figure 4:
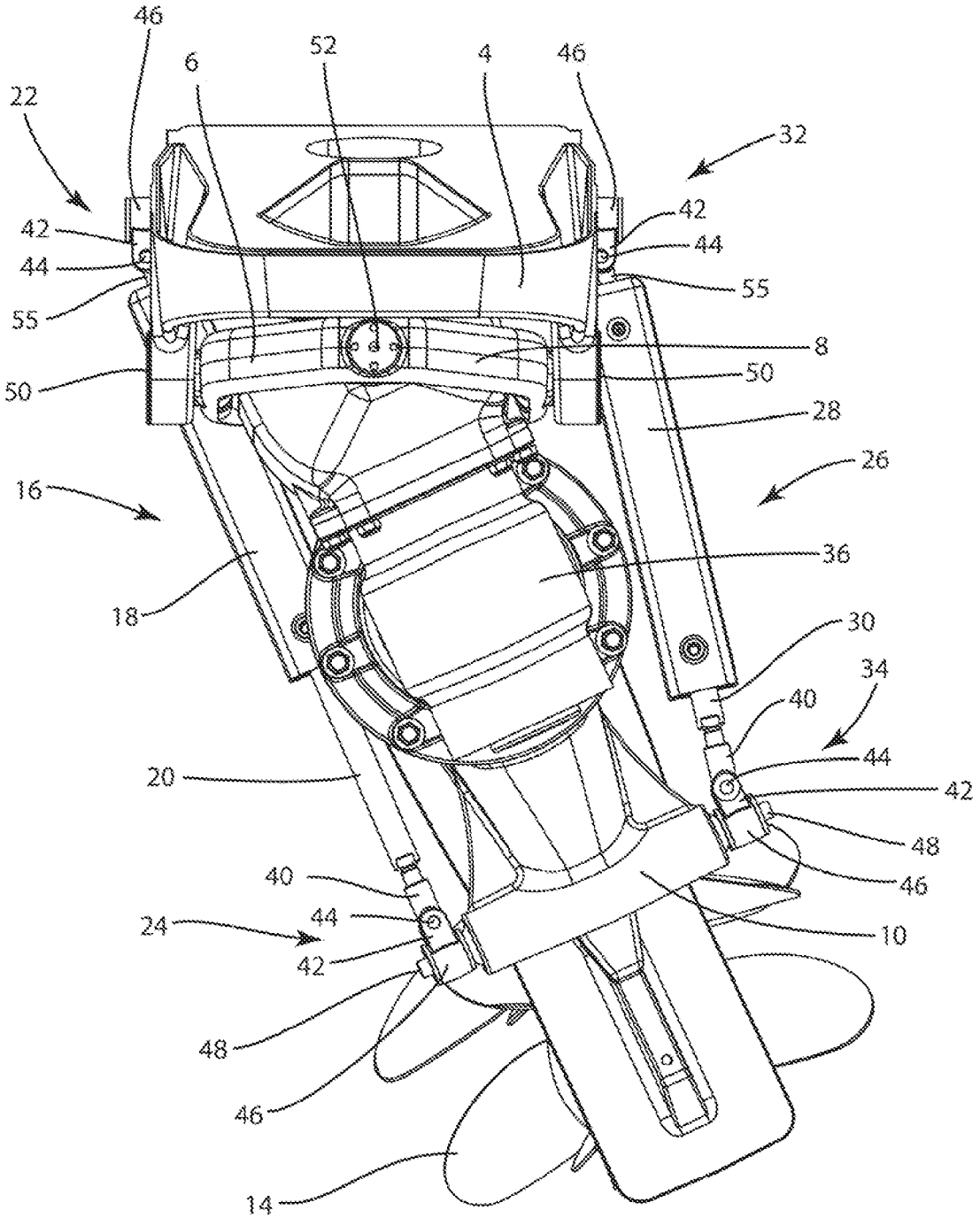
FIG. 4 is a top view of FIG. 3.

As shown in FIGS. 3 and 4, extension of the port hydraulic cylinder 16 coupled with retraction of the starboard hydraulic cylinder 26 causes the engine unit 2 to move horizontally and steer the watercraft starboard. Likewise, should the starboard hydraulic cylinder 26 be extended while the port hydraulic cylinder be retracted, the watercraft would be steered to port. FIGS. 3 and 4 demonstrate a full turn of the engine unit 2 to starboard, without vertical trim movement.

Figure 5:
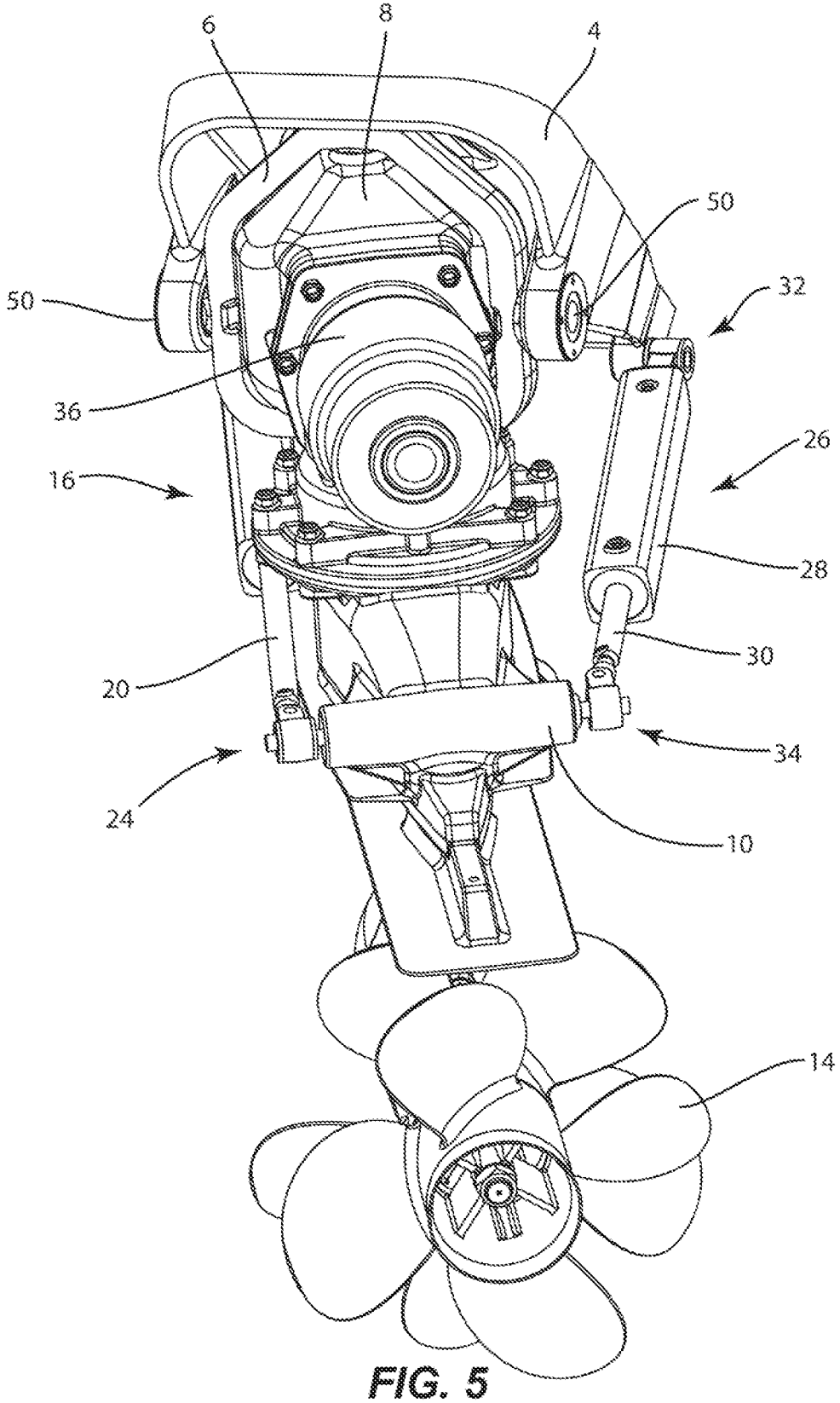
FIG. 5 is a perspective view of an engine unit incorporating the present invention wherein the port hydraulic cylinder is partially extending and the starboard hydraulic cylinder is partially extended to provide a starboard turn with trim.
Figure 6:
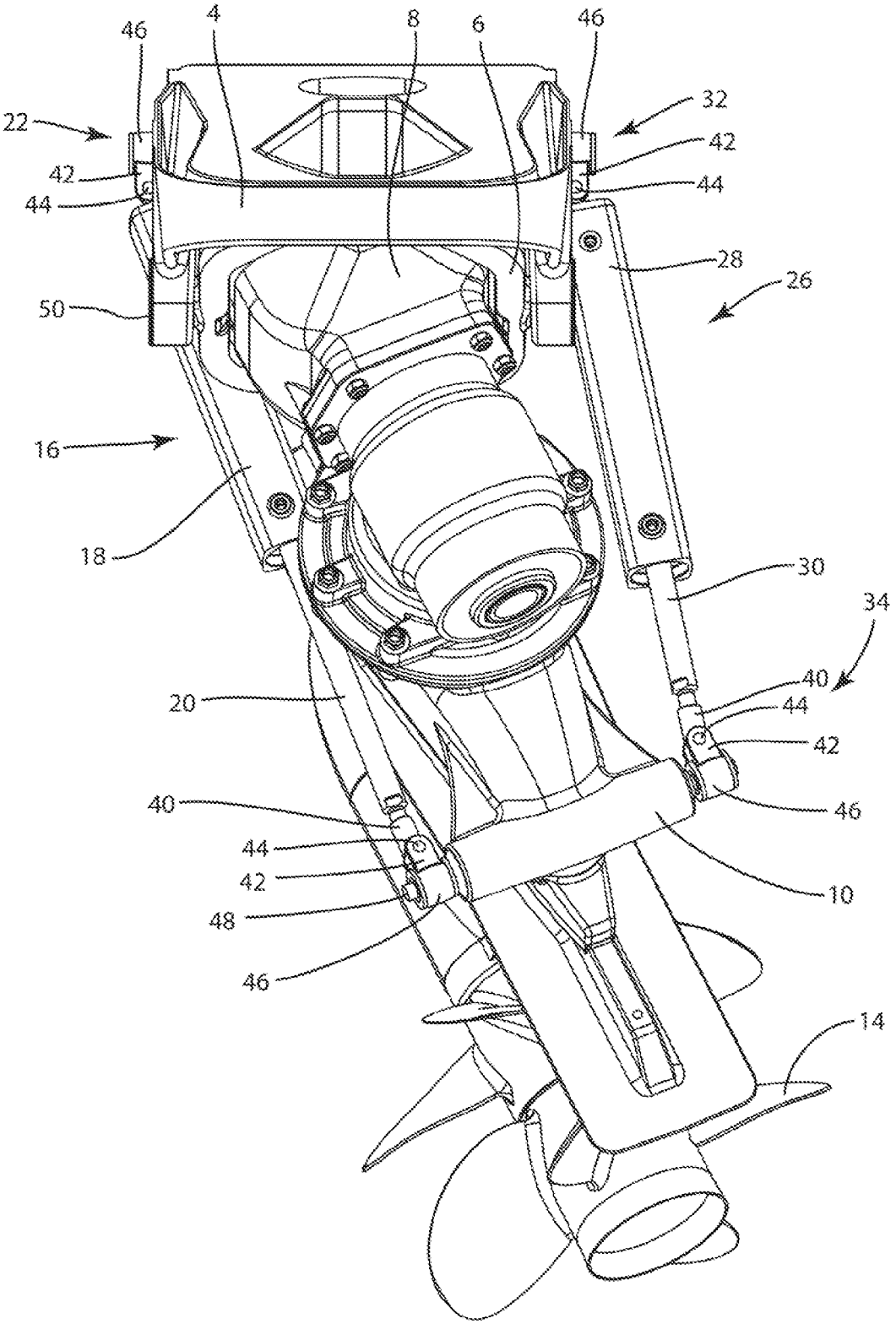
FIG. 6 is a top view of FIG. 5.

FIGS. 5 and 6 demonstrate full turn movement with trim of the engine unit 2. In this embodiment, the port hydraulic cylinder is partially extended, while starboard hydraulic cylinder is partially retracted causing both vertical and horizontal movement of the engine unit 2 to provide a starboard turn with trim. Should the starboard hydraulic cylinder 26 be partially extended while the port hydraulic cylinder 16 be partially retracted, a port turn with full trim would be executed. It will be evident to one of ordinary skill of the art that many different ranges of partial extension or retraction of the port or starboard hydraulic cylinders are contemplated with the present application that result in precise control of both steering and trim.

Figure 7:
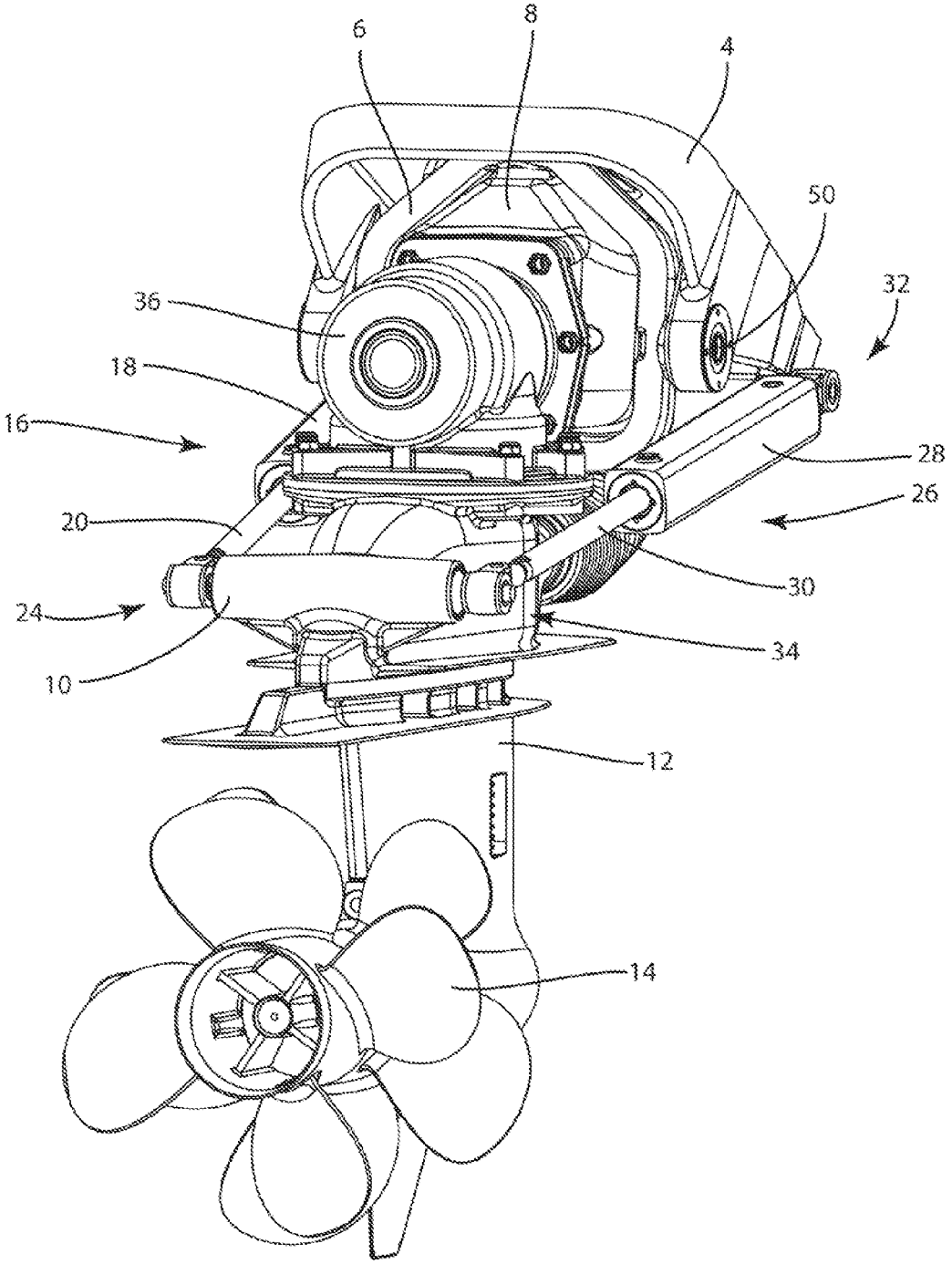
FIG. 7 is a perspective view of an engine unit incorporating the present application and demonstrating the port and starboard cylinders in a fully extended position to provide full trim to place the engine in a trailering position.
Figure 8:
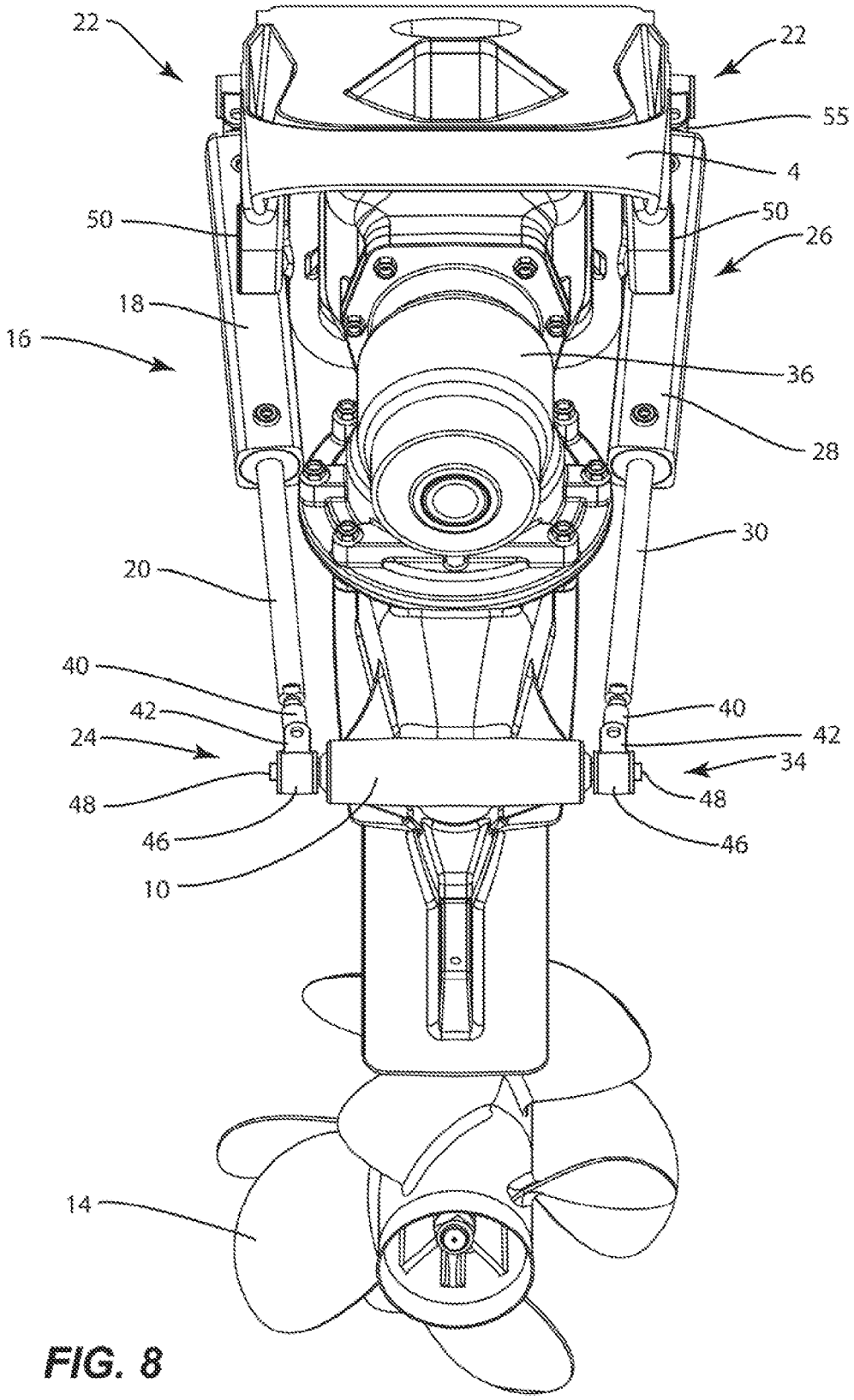
FIG. 8 is a top view of FIG. 7.

FIGS. 7 and 8 demonstrate the port hydraulic cylinder 16 and the starboard hydraulic cylinder 26 at full extension such that the engine unit 2 is raised to a full trim position. This full trim position is also contemplated as a trailering position. A surprising benefit of the present application is that at the full trim position as shown in FIGS. 7 and 8, the steering is locked by the nature of the mechanical system, eliminating the need for special trailering brackets and eliminating drive-to-drive interference. Further, the elimination of the need for any internal steering cylinders simplifies the sealing strategy of the engine unit and leaves additional space for exhaust, water flow, and other necessary transfers from inside or outside of the watercraft, particularly in stern drive embodiments.

Figure 9:
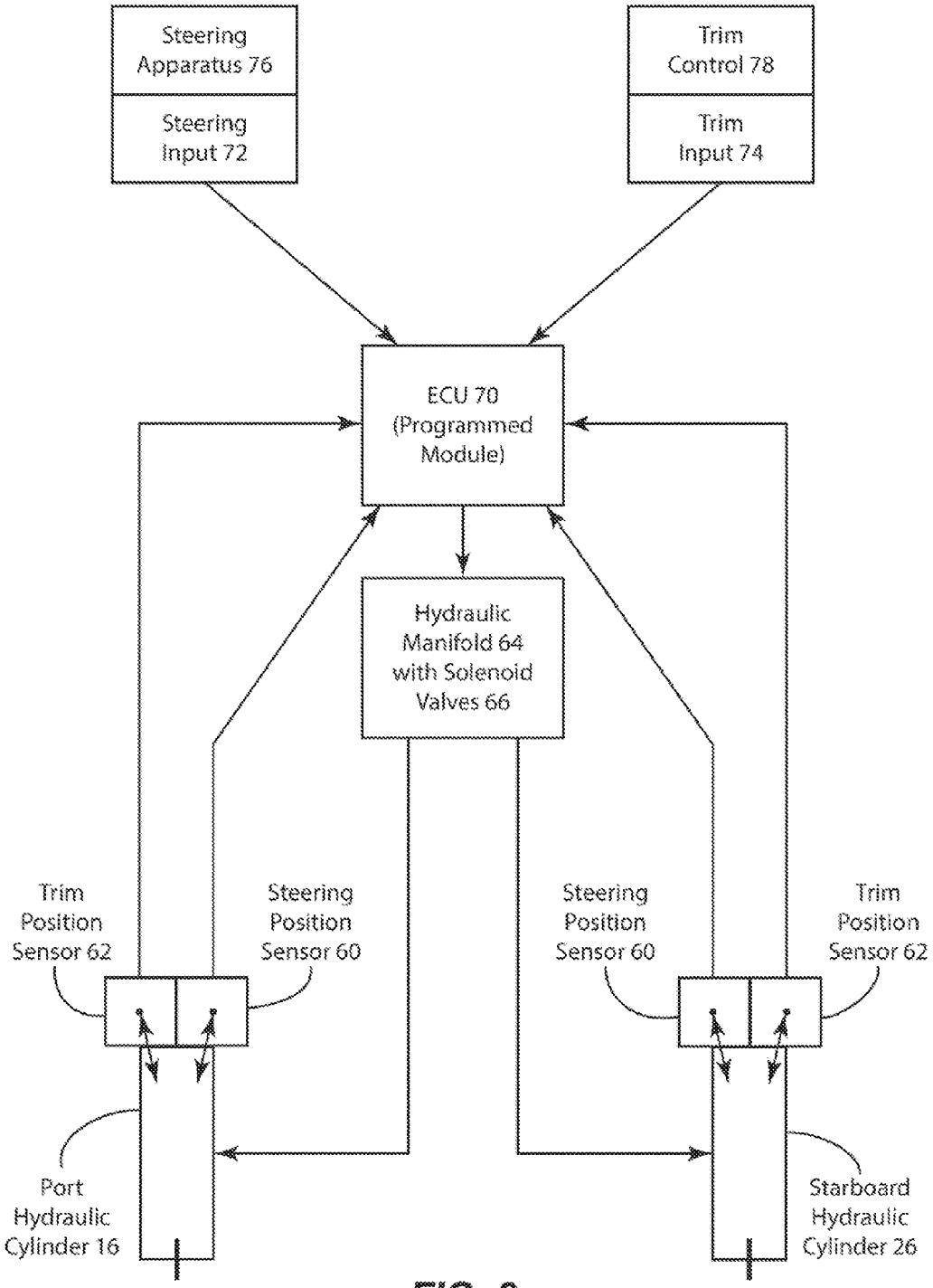
FIG. 9 is a control diagram demonstrating the control of the port hydraulic cylinder and the starboard hydraulic cylinder through the electronic control unit and hydraulic control manifold having solenoid valves.

FIG. 9 demonstrates the control scheme permitting the ability of the present application to fine tune the trim or steering rate to the boat through a steer and trim electronic control. This control scheme permits a user to change the speed of the steer or trim based on the desired performance attributes of the vessel. As shown in FIG. 9 an electronic control unit or ECU 70 is used to control a hydraulic manifold 64 having solenoid controlled valves 66. The ECU is a programmed module and may be programmed with additional control schemes in addition to the control of the port and starboard hydraulic cylinders described herein. The ECU 70 receives steering input 72 from a steering apparatus 76, such as a steering wheel. At the same time or separately, the ECU 70 receives trim input 74 from a trim control 78. Also at the same time, the ECU 70 may receive position inputs from trim position sensors 62 and steering position sensors 60. The trim position sensors 62 and steering position sensors 60 may be located on the respective port hydraulic cylinder 16 or starboard hydraulic cylinder 26. Alternatively, the position sensors may be located on the gimbal axis 52 and trim pivot 50. As will be recognized by one of ordinary skill in the art, the trim position sensors 62 will be located on the trim pivot 50, while the steering position sensors 60 will be located on the gimbal axis 52. In one embodiment of the present application at least one steering position sensor provides a steering position signal to the ECU 70 and at least one trim position sensor provides a trim position signal to the ECU 70. However, multiple sensors and signals may be provided to the electronic control unit 70.

Once the ECU 70 receives the steering input 72, the trim input 74, and the position inputs from the trim position sensors 62, and the steering position sensors 60, the ECU will send a signal to the solenoid valve 66 of the hydraulic manifold 64 to open or close the valves to provide or remove hydraulic fluid from the port hydraulic cylinder and/or the starboard hydraulic cylinder 26. The control of solenoid valves from electronic control unit is well known in the art, and any variation of the control scheme wherein the input is converted to an output to control the inflow or outflow of hydraulic fluid to the hydraulic cylinders to extend or retract the cylinder rods 20, 30 is contemplated as being within the scope of the present invention.

By example and without limitation, the ECU 70 may receive imports from the steering position sensors 60 and the trim position sensors 62 that the engine unit 2 is positioned for a starboard turn without trim as shown in FIGS. 3 and 4. When an operator actuates the steering apparatus 76 to turn to port, the ECU 70 will receive this steering input 72 and signal to the solenoid valves 66 of the hydraulic manifold 64 to retract the port hydraulic cylinder 16 and extend the starboard hydraulic cylinder 26 to execute the turn to port. A new steering position signal will then be sent from the steering position sensors 60 to the ECU 70. Should the operator then actuate the trim control 78 to adjust the pitch attitude, the ECU will receive the trim input 74, and send a signal to the solenoid valves 66 of the manifold 64 to extend the port cylinder 16 causing the engine unit 2 to trim upwardly. A new trim position signal will then be sent from the trim position sensors to the ECU 70. In this manner, the ECU 70 will continuously receive feedback input as to the steering and trim position of the engine unit 2.

The sensing strategy may use rotary position sensors located on the gimbal access 52 and the trim pivot 50 that would report the exact location of the drive at any time. As trim or steering inputs were made, the control software in the ECU 70 and the solenoid driven hydraulic valves on the hydraulic manifold 64 are utilized to push the drive to any demanded location. Alternatively, as noted, the position sensors may be located within the port hydraulic cylinder 16 and/or the starboard hydraulic cylinder 26 or at other desirable location on the engine unit 2.

Accordingly, the present application demonstrates a method and apparatus of steering and trimming an engine unit using only two hydraulic cylinders. In the preceding description certain terms were used for brevity, clearness and understanding. No unnecessary limitations are to be implied therefrom beyond the prior art because such terms are used for descriptive purposes only and are intended to be broadly construed. The different apparatuses and embodiments described herein may be used alone or in combination with other systems and methods. Various equivalents, alternatives and modifications are possible within the scope of the appended claims.

What is claimed is:

1. A system for combined control of steering and trim of a sterndrive unit generating a propelling force, the system comprising:

a gimbal housing and bell housing permitting steering movement about a gimbal axis and trim movement about a trim pivot that is perpendicular to the gimbal axis;

a drive connected to the bell housing;

a drive shaft housing connected to the drive and enclosing a drive shaft;

a gear case connected to the drive shaft housing, enclosing gears operatively connected to a drive shaft to rotate a propeller;

a port hydraulic cylinder that extends and retracts, the port cylinder having a first end and a second end, the first end connected to the sterndrive unit at a first port joint, the second end connected to the sterndrive unit at a second port joint;

a starboard hydraulic cylinder that extends and retracts, the starboard cylinder having a first end and a second end, the first end connected to the sterndrive unit at a first starboard joint, the second end connected to the sterndrive unit at a second starboard joint;

wherein the first and second port and starboard joints are configured such that both of the steering and trim movements are controlled by extension and retraction of the port and starboard hydraulic cylinders.

2. The system of claim 1, wherein the system further comprises:

position sensors connected to each of the port hydraulic cylinder and the starboard hydraulic cylinder and generating position signals;

a steering apparatus generating steering signals;

a trim control generating trim signals;

an electronic control unit, the electronic control unit receiving steering, trim and cylinder position signals and sending output signals;

a hydraulic manifold having solenoid controlled valves connected to the port hydraulic cylinder and the starboard hydraulic cylinder and operating to extend and retract the cylinders;

wherein the solenoid control valves receive output signals from the electronic control unit to extend or retract the port hydraulic cylinder and the starboard hydraulic cylinder.

3. The system of claim 2, wherein the position sensors include a steering position sensor and a trim position sensor.

4. The system of claim 2, wherein at least one position sensor is located on each hydraulic cylinder.

5. The system of claim 3, wherein at least one steering position sensor and at least one trim position sensor are located on each hydraulic cylinder.

6. The system of claim 3, wherein a steering position sensor is located on a gimbal axis of the gimbal ring and a trim position sensor is located on a trim pivot of the gimbal housing.

7. The system of claim 1, wherein the first port joint and the first starboard joint are connected to the gimbal housing.

8. The system of claim 1, wherein the second port joint and the second starboard joint are connected to the drive shaft housing.

9. The system of claim 1, wherein full extension of both the port hydraulic cylinder and the starboard hydraulic cylinder lifts the sterndrive unit to a trailering position and locks steering of the sterndrive unit.

10. A method of controlling steering and trim of an engine unit of a watercraft using two hydraulic cylinders, the method comprising:

providing a port hydraulic cylinder and a starboard hydraulic cylinder connected to the engine unit, the port and starboard hydraulic cylinders extending and retracting;

maintaining the port hydraulic cylinder and the starboard hydraulic cylinder at neutral positions for driving the watercraft straight without trim;

extending the port hydraulic cylinder and the starboard hydraulic cylinder to raise the engine unit upwardly and trim the watercraft;

extending the port hydraulic cylinder and retracting the starboard hydraulic cylinder to steer the watercraft to starboard;

extending the starboard hydraulic cylinder and retracting the port hydraulic cylinder to steer the watercraft to port;

partially extending the port hydraulic cylinder and partially retracting the starboard hydraulic cylinder to steer the watercraft to starboard with trim; and partially extending the starboard hydraulic cylinder and partially retracting the port hydraulic cylinder to steer the watercraft to port with trim.

11. The method of claim 10, wherein a hydraulic manifold with solenoid valves controlled by electronic signals from an electronic control unit that controls the extension and retraction of the port and starboard hydraulic cylinders.

12. The method of claim 11, wherein the method further comprises the steps of:

receiving in the electronic control unit a steering input signal from a steering apparatus;

sending a steering control signal from the electronic control unit to at least one solenoid valve of the hydraulic manifold to extend or retract a hydraulic cylinder;

receiving in the electronic control unit a trim input signal from a trim control; and sending a trim control signal from the electronic control unit to at least one solenoid valve of the hydraulic manifold to extend or retract a hydraulic cylinder.

13. The method of claim 12, wherein at least one steering position sensor provides a steering position signal to the electronic control unit and at least one trim position sensor provides a trim position signal to the electronic control unit.

14. The method of claim 13, further comprising the steps of:

receiving in the electronic control unit the steering position signal and the trim position signal;

adjusting the steering control signal based on the steering position signal; and adjusting the trim control signal based on the trim position signal.

15. The method of claim 10, wherein the step of extending the port hydraulic cylinder and the starboard hydraulic cylinder to raise the sterndrive unit upwardly and trim the watercraft further comprises fully extending the port hydraulic cylinder and the starboard hydraulic cylinder to raise the sterndrive unit to a trailering position.

16. The method of claim 15, wherein full extension of the port hydraulic cylinder and the starboard hydraulic cylinder locks any steering capability.

17. The method of claim 9, wherein the engine unit is an outboard engine unit.

18. The method of claim 9, wherein the engine unit is a sterndrive engine unit.

19. A system for combined control of steering and trim of a marine engine unit, the system comprising:

a steering apparatus generating steering signals that indicate steering movement about a gimbal axis;

a trim control generating trim signals that indicate trim movement about a trim pivot that is perpendicular to the gimbal axis;

an electronic control unit, the electronic control unit receiving steering, trim and cylinder position signals and sending output signals;

a port hydraulic cylinder that extends and retracts, the port cylinder having a first end and a second end, the first end connected to the engine unit at a first port joint, the second end connected to the engine unit at a second port joint;

a starboard hydraulic cylinder that extends and retracts, the starboard cylinder having a first end and a second end, the first end connected to the engine unit at a first starboard joint, the second end connected to the engine unit at a second starboard joint;

position sensors operatively connected to each of the port hydraulic cylinder and the starboard hydraulic cylinder and generating the position signals;

a hydraulic manifold having solenoid controlled valves connected to the port hydraulic cylinder and the starboard hydraulic cylinder and operating to extend and retract the cylinders;

wherein the solenoid control valves receive output signals from the electronic control unit to extend or retract the port hydraulic cylinder and the starboard hydraulic cylinder and wherein the first and second port and starboard joints are configured such that both of the steering and trim movements are controlled by extension and retraction of the port and starboard hydraulic cylinders.

20. The system of claim 19, wherein the engine unit is a sterndrive unit.

21. The system of claim 19, wherein the engine unit is an outboard unit.

22. The system of claim 1, wherein at least one of the first and second starboard joints is a double articulating joint.

23. The system of claim 1, wherein at least one of the first and second port joints is a double articulating joint.

* * * * *